US006993142B2

(12) United States Patent
Bordewijk

(10) Patent No.: US 6,993,142 B2
(45) Date of Patent: Jan. 31, 2006

(54) HEARING AID

(75) Inventor: Lourens George Bordewijk, Dordrecht (NL)

(73) Assignee: Audilux Science B.V., The Hague (NL)

( * ) Notice: Subject to any disclaimer, the term of this patent is extended or adjusted under 35 U.S.C. 154(b) by 150 days.

(21) Appl. No.: 10/148,583

(22) PCT Filed: Dec. 4, 2000

(86) PCT No.: PCT/NL00/00891

§ 371 (c)(1),
(2), (4) Date: Jun. 3, 2002

(87) PCT Pub. No.: WO01/41503

PCT Pub. Date: Jun. 7, 2001

(65) Prior Publication Data

US 2002/0181726 A1 Dec. 5, 2002

(30) Foreign Application Priority Data

Dec. 3, 1999 (NL) ..... 1013736
Dec. 23, 1999 (NL) ..... 1013949
Dec. 24, 1999 (NL) ..... 1013956

(51) Int. Cl.
*H05R 25/00* (2006.01)

(52) U.S. Cl. ..... 381/323; 381/322; 381/328; 381/324

(58) Field of Classification Search ..... 381/323, 381/322, 328, 330, 314, 324
See application file for complete search history.

(56) References Cited

U.S. PATENT DOCUMENTS 2,959,645 A * 11/1960 Ladd ..... 381/323
4,532,649 A 7/1985 Bellafiore
4,672,672 A * 6/1987 Eggert et al. ..... 381/324
4,870,688 A * 9/1989 Voroba et al. ..... 381/60
5,790,672 A * 8/1998 Klostermeier ..... 381/328
5,825,896 A * 10/1998 Leedom ..... 381/322
6,577,740 B1 * 6/2003 Bordewijk ..... 381/323

FOREIGN PATENT DOCUMENTS

DE 85 32 332 4/1986
WO 99 13686 3/1999

* cited by examiner

*Primary Examiner*—Huyen Le
*Assistant Examiner*—Tuan Duc Nguyen
(74) *Attorney, Agent, or Firm*—Young & Thompson

(57) ABSTRACT

Hearing aid consisting of two parts that can be separated. A chamber for accommodating a battery is delimited between the two parts. The loudspeaker is located some distance away from the sound-emitting opening and the connecting channel between the loudspeaker and the sound-emitting opening comprises the cavity in which the battery is accommodated.

18 Claims, 1 Drawing Sheet

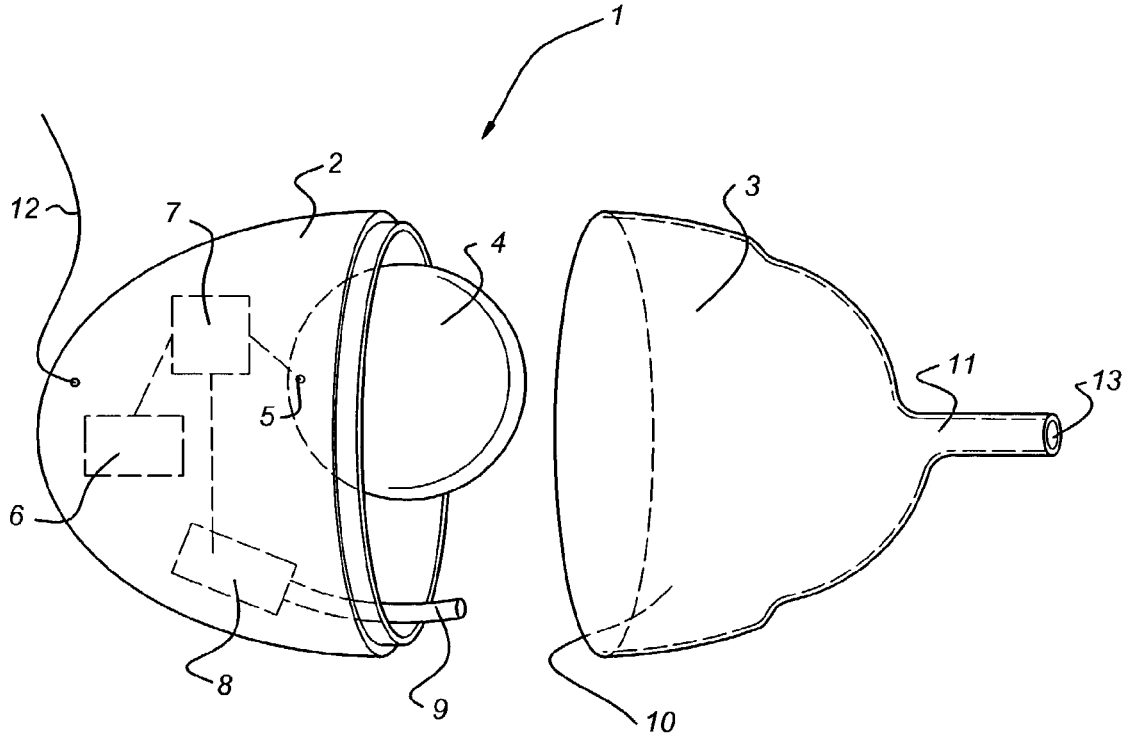
1
2
3
4
5
6
7
8
9
10
11
12
13

HEARING AID

BACKGROUND OF THE INVENTION

The present invention relates to a hearing aid comprising at least two parts which can be separated and within which a chamber for accommodating a battery is delimited, provided with a microphone, an amplifier that processes the signal originating from the microphone and a loudspeaker, said loudspeaker being connected via a connecting channel to a sound-emitting opening in said hearing aid.

A hearing aid of this type is generally known in the prior art. With such a hearing aid the loudspeaker is some distance away from the sound-emitting opening and a connecting channel to the sound-emitting opening from the loudspeaker is required. Aids of this type are in particular intended to be fitted very deeply in the auditory canal, preferably in such a way that no parts are located outside the auditory canal. With this arrangement the problem arises that secretions from the ear permeate the sound conduit and are able to damage the loudspeaker here. Moreover, if the sound conduit is blocked this has an appreciable adverse effect on the sound quality. Such blockages are particularly difficult to remove and there is a risk that the user will damage the loudspeaker when cleaning the sound conduit. This is one of the reasons why hearing aids of this type which are placed deep in the ear are not yet in general use.

In the prior art it is proposed to fit a filter in the sound-emitting opening. In view of the size of such hearing aids and the size of the sound conduit it is clear that such filters are particularly small and have a very low capacity. Therefore these filters have to be regularly replaced, which is laborious.

According to another proposal developed in the prior art, a non-return valve is arranged in the sound conduit. Various variants of this are known but practice has shown that such valves are both vulnerable and unreliable because these become blocked by the secretions from the ear and then no longer function.

SUMMARY OF THE INVENTION

The aim of the present invention is to solve the problems indicated in the prior art and to increase the acceptance of hearing aids placed very deep in the ear.

This aim is realised with a hearing aid as described above in that the connecting channel comprises the chamber for accommodating a battery.

According to the invention the chamber for accommodating a battery also forms part of the connecting channel. This chamber is readily accessible by separating the two parts which make up the hearing aid. The battery chamber itself serves as a buffer for any secretion that enters the hearing aid from the sound-emitting opening via the channel adjoining the latter. That is to say, the empty space around the battery first has to be filled by secretion before material can possibly reach the loudspeaker of the hearing aid. Such a situation is inconceivable because the functioning of the hearing aid is reduced to such an extent long before that time is reached, so that the user will be forced to clean the various components.

This means that according to the invention the risk of secretion passing beyond the chamber for accommodating the battery is precluded. Moreover, further miniaturisation is possible with the present invention. After all, by using the chamber for accommodating the battery as sound conduit as well, savings can be made in respect of the space for the sound conduit and more particularly in respect of the wall thickness of such a conduit.

More particularly, this construction is advantageous if, viewed in the fitted position, the battery is closer to the eardrum than is the loudspeaker. It has been found that as a result of the shape of the auditory canal such an arrangement is optimum and provides excellent fixing of the hearing aid, whilst, moreover, it is easy to achieve soundproof closure of the auditory canal. After all, the battery is the largest component of a hearing aid.

According to an advantageous embodiment of the invention all electrical components are contained in the one part of the hearing aid and the other part is constructed as a cover in which the sound-emitting opening has also been made. Such a cover can easily be cleaned. Moreover, it is possible according to the invention to construct such a cover as the individualised part, that is to say the part that corresponds to the shape of the auditory canal. The expensive part in which the electronics are located can be constructed as a universal part and, after the exterior of the cover has been shaped to size, a hearing aid matched to the individual requirements can be provided. It will be understood that such an individualisation of the cover is appreciably less expensive than tailoring the part in which the electronic components are present, even apart from the risk of damaging the latter. Optionally such shaping of the cover to size can comprise applying an individualised layer of material acting as a seal. Moreover, markings can be made which individualise such a cover.

According to a further advantageous embodiment of the invention in which the loudspeaker is closer to the outlet of the auditory canal than is the battery, a connecting channel is present between the loudspeaker and the battery in the part in which the electronic components are present. This connecting channel opens into the chamber for accommodating the battery. According to a further advantageous embodiment, a further connecting channel extends from the chamber for accommodating the battery into the cover, which channel leads to the eardrum. This channel can be integrated with the cover or can project therefrom.

According to a further advantageous embodiment of the invention the chamber for accommodating the battery is soundproof after closing the base part, in which the electronic components are located, with the cover. Moreover, as already indicated above, the cover provides a seal between the hearing aid and the auditory canal.

According to a further advantageous embodiment a pull thread or the like is present by means of which the hearing aid can be removed from the ear.

According to a further advantageous embodiment with which a connecting channel is present between the loudspeaker and the chamber for accommodating the battery, such a sound conduit extends beneath the battery in the use position, that is to say the opening thereof opens into the chamber for accommodating the battery below the battery.

That part of the cover that provides a connection with the sound-emitting opening can be arranged either centrally or on the top of the cover. This, of course, refers to the use position of the hearing aid.

According to a further advantageous embodiment the connection between loudspeaker and emission opening is made such that the cross-sectional dimension thereof is essentially constant. This relates both to the surface and to the shape thereof. This also applies in respect of the chamber for accommodating the battery. Therefore, that part of the sound conduit that extends into said accommodation chamber will preferably be above, below or alongside the battery.

According to an advantageous embodiment of the invention the chamber for accommodating the battery is acoustically sealed. This is, of course, except for the connection to the loudspeaker and the sound-emitting opening.

BRIEF DESCRIPTION OF THE DRAWING

The invention will be explained in more detail below with reference to an illustrative embodiment shown in the drawing. In the drawing:

FIG. 1 shows the hearing aid according to the invention separated into its parts and partially in cross-section.

DETAILED DESCRIPTION OF THE RPEFERRRED EMBODIMENTS

In FIG. 1 the hearing aid according to the invention is shown by 1. The hearing aid consists of a base part 2 and a cover 3. Base part 2 is provided with the electronic components, comprising a microphone 6, an amplifier/processor 7 and loudspeaker 8. Power is supplied by a battery 4 which makes contact with contact 5. Loudspeaker 8 is provided with a flexible sound tube 9. This opens into the chamber for accommodating the battery which is delimited when cover 3 and base part 2 slide over each other. The accommodating cavity in the cover 3 is indicated by 10. Cover 3 is provided with a flexible sound tube 11 that opens into a sound-emitting opening 13.

12 indicates a removal thread which is made such that on pulling thereon the hearing aid is moved through the user's auditory canal and removed from the auditory canal.

It can be seen from the figure that the sound-emitting opening 13 can be placed very close to the user's eardrum. Any secretions originating from the auditory canal are able to pass through flexible sound tube 11 into the chamber for accommodating the battery. However, there is no need to be concerned about passage into flexible sound tube 9. After all, when the chamber for accommodating the battery becomes full, the various components automatically become blocked so that further passage is not possible and the user is forced, because of the decreasing quality of the sound and possible pressure on the ear, to remove the aid and clean it.

It can be seen from the drawing that this cleaning is particularly simple. After all, by removing the cover 3 the latter can easily be cleaned and there is no risk of damaging the electronic components. Secretions from the ear will essentially be present in the cover 3.

It can be seen from the drawing that in the use position the loudspeaker 8 is further away from the eardrum than is the battery 4. In this way the shape of the base part 2 can be optimally adapted to the shape of the auditory canal. After all, such a battery is the largest component in a hearing aid. In this way the shape can be adapted such that the hearing aid does not have the tendency to work its way out of the ear and the part having the largest dimension can be arranged "downstream" of the condyles of the mandible, so that there is no risk of the hearing aid moving outwards when making chewing movements.

According to an advantageous embodiment of the invention it is optionally possible to incorporate a non-return valve, which prevents secretions moving backwards, in the flexible sound tube 9.

Although the invention has been described above with reference to a preferred embodiment, those skilled in the art will immediately be able to conceive variants on reading the above description and such variants are obvious following the above and fall within the scope of the appended claims. For instance, the invention can be employed with all hearing aids which are at least partially fitted in the ear.

What is claimed is:

1. Hearing aid comprising:

two parts which can be separated and within which a chamber for accommodating a battery is delimited, provided with a microphone, an amplifier that processes the signal originating from the microphone and a loudspeaker for producing sound, said sound of said loudspeaker being fed via a sound channel to a sound-emitting opening in said hearing aid, wherein said sound channel comprises the chamber for accommodating a battery.

2. Hearing aid according to claim 1, wherein said loudspeaker and microphone are located in a first one of said two parts.

3. Hearing aid according to claim 2, wherein said first part contains all electrical components and a second part of said two parts is constructed as a cover.

4. Hearing aid according to claim 1, wherein said sound channel comprises a channel extending from the chamber for accommodating the battery to the sound-emitting opening.

5. Hearing aid according to claim 4, wherein said channel extending from the chamber is a flexible tube, which is connected to one part of said two parts of the hearing aid and extends beyond it.

6. Hearing aid according to claim 1, wherein the sound channel comprises a channel extending from the loudspeaker to the battery chamber.

7. Hearing aid according to claim 6, wherein, when the hearing aid is fitted, said sound channel extends from the bottom of the chamber for accommodating the battery.

8. Hearing aid according to claim 6, wherein said sound channel contains a non-return valve.

9. Hearing aid according to claim 1, wherein said chamber for accommodating the battery is acoustically sealed.

10. Hearing aid according to claim 7, wherein said sound channel contains a non-return valve.

11. A hearing aid comprising:

a first part;

a second part removably connected to said first part;

a microphone, an amplifier that processes a signal originating from said microphone, and a loudspeaker connected to said microphone, in said second part;

a sound-emitting opening in said first part;

a connecting channel in said first part between said loudspeaker and said sound-emitting opening; and a battery within said connecting channel.

12. The hearing aid according to claim 11 wherein part of said connecting channel is a flexible tube, which is connected to said part of said connecting channel and extends beyond said first part to said sound-emitting opening.

13. The hearing aid according to claim 11, further comprising an additional channel extending from said loudspeaker into said first part.

14. The hearing aid according to claim 13, wherein said additional channel contains a non-return valve.

15. The hearing aid according to claim 11, wherein said first and second parts define a chamber therebetween that is acoustically sealed.

16. A hearing aid comprising:

two parts that are separable from each other and that delimit therebetween a chamber for accommodating a battery and electrical components of said hearing aid;

a sound emitting opening on one of said two parts;

a loudspeaker for producing sound, said loudspeaker being located in another one of said two parts; and a sound channel feeding the sound from said loudspeaker to said sound emitting opening, said sound channel having said battery therein.

17. The hearing aid according to claim 11, wherein said second part is removably connected to said first part so that only a peripheral edge of said first and second parts overlap.

18. The hearing aid according to claim 6, wherein said channel extending from the loudspeaker is positioned between said two parts.

* * * * *